US005960835A

United States Patent [19]

Izaki et al.

[11] Patent Number: 5,960,835

[45] Date of Patent: Oct. 5, 1999

[54] CAST IRON PIPE SURFACE-MODIFIED FOR CORROSION PREVENTION AND METHOD OF MODIFYING THE CAST IRON PIPE SURFACE FOR CORROSION PREVENTION

[75] Inventors: Hiroshi Izaki, Suita; Masanori Yoshino, Kishiwada; Manabu Kurotobi, Takarazuka; Mutsuo Uchida, Osaka; Hiroaki Shimizu, Yao, all of Japan

[73] Assignee: Kubota Corporation, Osaka, Japan

[21] Appl. No.: 08/859,149

[22] Filed: May 20, 1997

[30] Foreign Application Priority Data

Aug. 6, 1996 [JP] Japan ..... 8-206732

[51] Int. Cl.[6] ..... F16L 9/14; C23C 4/06

[52] U.S. Cl. ..... 138/145; 138/146; 138/DIG. 6; 427/455

[58] Field of Search ..... 138/145, 146, 138/DIG. 6; 427/455, 456, 546; 428/36.9

[56] References Cited

U.S. PATENT DOCUMENTS

| | | | |
|---|---|---|---|
| 4,605,484 | 8/1986 | Shiroki et al. | 204/290 R |
| 5,476,725 | 12/1995 | Papich et al. | 148/523 X |
| 5,509,978 | 4/1996 | Masumoto et al. | 148/403 |

*Primary Examiner*—Patrick Brinson

*Attorney, Agent, or Firm*—Reising, Ethington, Barnes, Kisselle, Learman & McCulloch, PC

[57] ABSTRACT

A cast iron pipe surface-modified for preventing corrosion and a method of modifying the pipe surface for corrosion prevention. A corrosion preventive coating is formed on the surface of the iron material of the pipe. The corrosion preventive coating is made up of an aluminum alloy containing not less than 5 wt % but not more than 25 wt % of Mn, the remainder being Al, the aluminum alloy being such that the manganese is present as a supersaturated solid solution in an aluminum phase. The corrosion preventive coating is formed by thermally spraying a quenched aluminum alloy of the above noted composition onto the surface of the iron material of the pipe.

5 Claims, 1 Drawing Sheet

CAST IRON PIPE SURFACE-MODIFIED FOR CORROSION PREVENTION AND METHOD OF MODIFYING THE CAST IRON PIPE SURFACE FOR CORROSION PREVENTION

FIELD OF THE INVENTION

The present invention relates to a cast iron pipe surface-modified for corrosion prevention and a method of modifying the cast iron pipe surface for corrosion prevention.

BACKGROUND OF THE INVENTION

Cast iron pipes, such as ductile cast iron pipes, are often formed on the surface thereof with a corrosion preventive layer for protection of the surface against corrosion. Known types of corrosion preventive coatings include a coating formed by applying a paint to the surface, and a sprayed coating formed by arc spraying a metal material such as a zinc alloy on the surface of the pipe.

Of these types of coatings, the former type in which the coating is formed by mere paint coating has a disadvantage that where a pipeline is installed in a highly corrosive environment, any corrosion, once it occurred, cannot be prevented from progressing further. Where the pipeline is buried in the ground, the coating may be partially scraped off the surface during the work for pipeline placement whereby the pipeline is rendered partially defective so that a local corrosion may readily develop at the defective portion of the pipeline.

In the case of sprayed zinc alloy coating, the coating functions as a sacrifice electrode because zinc exhibits a higher degree of ionization tendency than iron or the material of the pipe. Therefore, improved anti-corrosion effect can be obtained as compared to the case of mere paint coating. However, when the sprayed zinc alloy coating has been completely consumed as the sacrifice electrode, the coating can no longer provide any corrosion preventive effect. Another disadvantage is that since zinc is so soft that the coating, as is the case with the mere paint coating, may be partially scraped off the pipe surface and rendered defective so that the material iron is locally exposed and made susceptible to corrosion. In the case of a surface coating being formed by arc spraying, the coating may be porous so that an oxide scale tends to be formed between the iron material and the coating, resulting in lowered anti-corrosion effect of the coating.

DISCLOSURE OF THE INVENTION

Therefore, it is a primary object of the present invention to provide a cast iron pipe having improved corrosion preventive performance as compared to prior art cast iron pipes.

In order to accomplish this object, the invention presents a cast iron pipe surface-modified for preventing corrosion, in which a corrosion preventive coating is formed on the surface of iron material of the pipe, characterized in that the corrosion preventive coating is comprised of an aluminum alloy containing not less than 5 wt % but not more than 25 wt % of Mn, the remainder being Al, the aluminum alloy being such that the manganese is present as a supersaturated solid solution in an aluminum phase.

Generally, it is believed that when manganese is mixed into aluminum, the aluminum is adversely affected in corrosion resistance and strength. However, where a manganese-added aluminum alloy is quench-solidified, for example, the manganese is supersaturated in the aluminum to form a solid solution, and a dense intermetallic compound is uniformly distributed in the aluminum alloy matrix. As a result, the aluminum alloy has good corrosion resistance.

By forming a coating of such an aluminum alloy on the surface of a cast iron pipe by thermal spraying, it is possible to provide an aluminum alloy coating such that an intermetallic compound is uniformly dispersed in the entire structure. The coating thus obtained can exhibit good corrosion preventive performance. In this case, after formation of the coating, there is no particular need for after-treatment as intended for improvement of the corrosion resistance of the coating, for example, heat treatment such as diffusion or annealing. Therefore, the process of coating is simplified, resulting in good saving in the cost of production.

According to the present invention, as material for forming a corrosion preventive coating is used an aluminum alloy containing, in addition to Mn, more than 0 wt % but not more than 15 wt % of Si or Mg or both combined together, the aluminum alloy being such that the manganese and the silicon and/or magnesium are present as a supersaturated solid solution in the aluminum phase.

Since the aluminum alloy contains silicon and/or magnesium in this way, the hardness of the corrosion preventive coating is improved so that any degradation of the corrosion preventive performance of the coating due to the coating being damaged can be inhibited. Further, because of the presence of magnesium in particular in the coating, the natural potential of the corrosion preventive coating is lower than the corrosion preventive potential of the iron base of the pipe and, therefore, the corrosion preventive coating serves also as a sacrifice anode for corrosion prevention.

DESCRIPTION OF THE PREFERRED EMBODIMENTS

Figure 1:
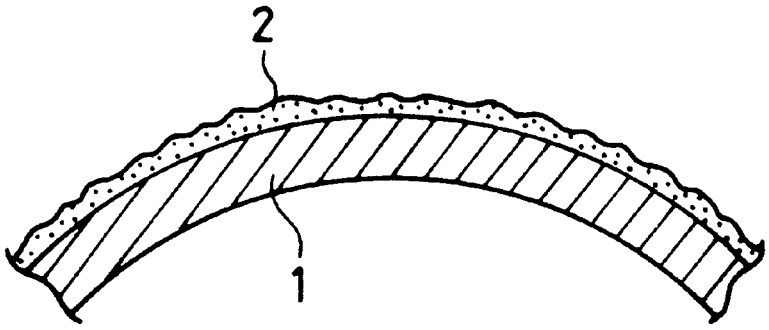
FIG. 1 is a fragmentary view in cross section of a cast iron pipe surface-modified for protection against corrosion in accordance with one embodiment of the present invention.

In FIG. 1, reference numeral 1 designates an iron base of a ductile cast iron pipe with a corrosion preventive coating 2 formed on the surface of the iron base 1. The corrosion preventive coating 2 is a coating formed by flame spraying a quench-solidified powder of aluminum alloy onto the surface of the iron base 1 at a super high speed.

Figure 2:
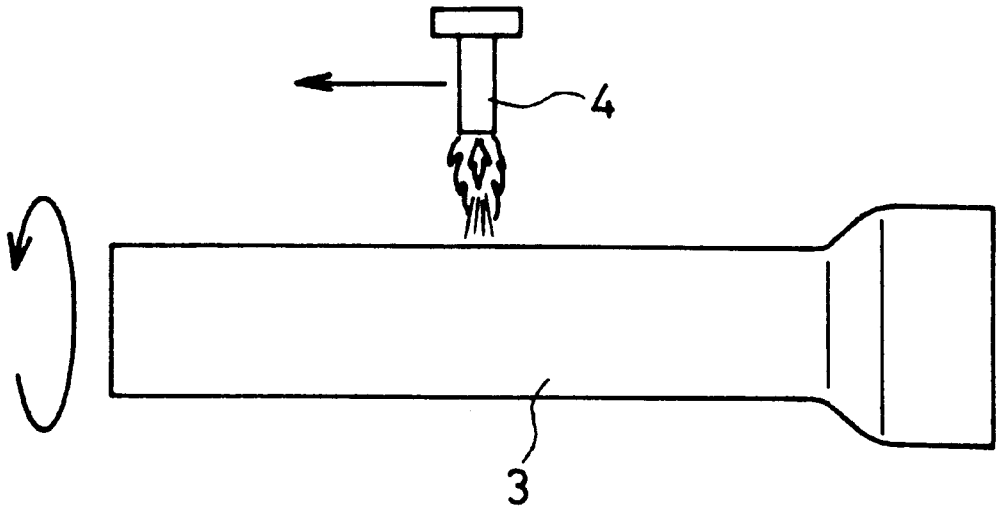
FIG. 2 is a schematic view illustrating the method of forming a corrosion preventive surface coating on a cast iron pipe in accordance with the embodiment of the invention.

FIG. 2 illustrates the method of flame spraying. As shown, the cast iron pipe 3, as horizontally supported, is rotated on its axis, and an ultrahigh speed thermal spray gun 4, while moving along the axis of the pipe 3, performs spraying over the cast iron pipe 3.

The quench-solidified powder comprised of an aluminum alloy is produced from an aluminum stock comprising pure aluminum and a manganese component incorporated therein and, where required, some other elements to be described hereinafter, the aluminum stock being heated to a temperature which is 50 to 200° C. higher than the melting point of the aluminum, and melted. The melt is produced into a powder mass by, for example, a rotary stream method.

The rotary stream method is a method of producing an aluminum alloy powder by forming a cooling liquid bed which flows down along the inner periphery of a cooling cylinder while swivelling thereabout, and supplying a molten metal jet of aluminum alloy to the cooling liquid bed. According to this method, the molten metal of aluminum alloy is scissioned by the swivelling cooling liquid bed and quench-solidified in the cooling liquid bed. In this case, cooling is performed at a very high rate and a metal powder that has been rendered amorphous can be readily obtained. Further, according to this method, the quench-solidifying conditions, such as cooling rate, are readily adjustable and a powder mass in which intermetallic compounds to be hereinafter described are dispersed as desired can be produced according to such conditions.

According to the above described method for powder production, quench-solidification is carried out at a cooling rate of, for example, about $10^{4\circ}$ C./sec or more, and thus a quenched aluminum alloy powder is obtained such that manganese is present as a supersaturated solid solution in an aluminum base. Further, intermetallic compounds comprised of manganese and aluminum are formed in dispersion within the aluminum base, the size of such compounds being of a minute order, say, several $\mu$m.

The quenched aluminum alloy powder is such that, as stated above, the manganese is present as supersaturated solid solution in the $\alpha$-aluminum phase, the solid solution acting as a reinforcement for the base material. Further, because of the fact that a minute and dense intermetallic compound is uniformly distributed in the aluminum alloy matrix, the aluminum alloy exhibits good corrosion resistance.

Spraying of such a quenched aluminum alloy powder, as thermal spray material, is carried out according to the flame spray method as shown in FIG. 2 to form a corrosion preventive coating 2 of the aluminum alloy on the surface of the iron base 1 as shown in FIG. 1. The corrosion preventive coating 2 thus formed on the surface of the iron base 1 has uniform thickness and has above mentioned intermetallic compound uniformly dispersed in its structure throughout. Therefore, the coating has high corrosion resistance attributable to the intermetallic compound, thus exhibiting satisfactory corrosion preventive performance for the iron base. Hence, the coating is not liable to corrosion development even in a corrosive environment and maintains good anti-corrosion effect.

Once the corrosion preventive coating 2 of the aluminum alloy is formed on the surface of the iron base 1, there is no need for such after-treatment as has been required in the prior art for improvement of the corrosion resistance of the coating. In other words, the coating can prevent corrosion of the iron base 1 without conducting any heat treatment such as diffusion or annealing as after treatment. This simplifies the process of surface modification for corrosion prevention and provides more cost effective operation.

The quantity of Mn in the aluminum should be not less than 5 wt % but not more than 25 wt %. If the quantity of Mn is less than 5 wt %, the quantity of the intermetallic compound will be insufficient and, therefore, a corrosion preventive coating having good corrosion preventive characteristic cannot be obtained. If the quantity of Mn is more than 25 wt %, the quantity of the intermetallic compound will be excessive and, as a result, the material of the coating becomes fragile, which in turn results in coarse grain precipitation. As such, no good corrosion preventive effect could be expected. More preferably, therefore, the quantity of Mn is not less than 10 wt % but not more than 20 wt %.

Where the quenched aluminum alloy powder includes, in addition to Mn of the above quantity range, more than 0 wt % but not more than 15 wt % of Si or Mg or both combined together, improvement in the hardness of the corrosion preventive coating 2 can be obtained, in addition to the above mentioned advantage of corrosion resistance.

The reason for this is that the corrosion preventive coating 2 of the aluminum alloy in this case has good corrosion resistance attributable to the intermetallic compound as well and, in addition, presents a structure of greater hardness because of the presence of Si and/or Mg as a solid solution in the aluminum base. This inhibits any degradation of the corrosion preventive characteristic of the coating due to the coating being damaged. The formation of such a coating having high corrosion resistance and increased hardness in combination results in further improvement in the corrosion preventive performance of the coating with respect to the iron base 1.

The Si and/or Mg content, as described above, has a function to increase hardness without involving any degradation in the corrosion resistance. However, if it is present in excess of 15 wt %, the aluminum alloy becomes brittle. More preferably, therefore, the quantity of Si and/or Mg is not more than 10 wt %.

The presence of Mg in particular results in the natural potential of the corrosion preventive coating 2 being lower than the natural potential of the iron base 1. Therefore, the coating has additional corrosion preventive function as a sacrifice anode. Hence, even if any damage is caused to the coating 2, there is no possibility of corrosion occurring to the iron base 1 at the damaged site. Thus, the coating can maintain stabilized corrosion preventive characteristics over a long period of time.

Further, the presence of Mg provides improved adhesion of the corrosion preventing coating 2 to the iron base 1. That is, despite the fact that the Si content exceeds a certain amount, the alloy tends to become brittle and is thus liable to separation during a thermal spray operation, the presence of Mg in the coating inhibits the occurrence of such a tendency. Where the coating is held at ordinary temperatures for 72 hours, for example, after the thermal spray operation, ageing occurs so that fine precipitates are formed in the texture of the corrosion preventive coating 2 of the aluminum alloy. These precipitates enable the coating 2 to maintain high hardness. Therefore, even if the Si content is held down, the hardness of the coating can be maintained high so that the material is prevented from becoming brittle. Thus, separation of the coating 2 during the process of thermal spraying or the like can be prevented.

In the foregoing description of the method for production of the quenched aluminum alloy powder, the rotary stream method is taken up by way of example. Alternatively, however, other powder production method, such as water atomizing method or gas atomizing method, may be employed as desired. A quench-solidified alloy material in powder form has been described as the spray material, but it is understood that the material to be used is not limited to such form of material. For example, it is possible to use a rod-like or wire-like molded material as produced from a quenched aluminum alloy powder by hot metal forming, such as hot extrusion or hot forging. It is also possible to use a quench-solidified alloy material formed into a rod-like or wire-like shape by any suitable quench-solidifying method directly from aluminum molten metal.

The thermal spray technique to be employed for forming the corrosion preventive coating 2 of aluminum alloy is not limited to flame spraying. It is possible to employ a plasma spray method, for example, using electricity as a heat source therefor. Use of such a spray method permits uniform distribution of an intermetallic compound having good corrosion preventing characteristic over a wide range of area on the surface of the iron base 1. Therefore, the uniformity of the corrosion preventive effect of the coating will not be impaired on the surface of the iron base 1.

Specifically, the flame spray method is such that the quenched aluminum alloy material is supplied into a flame produced by acetylene, a fuel gas, and oxygen so that the surface of the material is melted, the resulting melt being sprayed by compression gas over the surface of the iron base 1 thereby to form the coating 2. For the purpose of forming the corrosion preventive coating 2 of the aluminum alloy using this method, the quenched aluminum alloy material is kept in a semi-molten state in which only the surface of the material is melted, and the melt is sprayed over the surface of the iron base 1 at a super-high speed which exceeds the speed of sound. In this case, with the energy of impact by spraying being considered, setting of conditions for deposition of the coating to the surface of the iron base 1 is made. As a result, a corrosion preventive coating 2 in such a condition that the texture of quenched aluminum alloy material remains almost unchanged is formed. Thus, the corrosion preventive characteristic of the quenched aluminum alloy can be more positively incorporated into the corrosion preventive coating 2.

EXAMPLES AND COMPARATIVE EXAMPLES

Comparative Example 1

Measurement was made of the surface hardness of a ductile cast iron pipe on which a thermal spray coating was to be formed. The surface hardness was within the range of Hv200–220. The ductile cast iron pipe was subjected to a salt water spray test with respect to its surface. Twenty-four hours after the test, rusting was witnessed with the pipe. The natural potential of the ductile cast iron pipe was measured using a silver-chloride silver electrode. The measurement results indicated −673 mV in relation to service water, and −666 mV in relation to 3% common salt water. Measurement results with respect to these characteristics are shown in Table 1.

Example 1

A quenched aluminum alloy powder comprised of 90 wt % Al and 10 wt % Mn was produced, and the alloy powder was sprayed over the surface of a cast iron pipe by using a super-high speed flame spray gun, whereby a corrosion preventive coating was formed on the cast iron pipe surface. In this case, the spray yield was 45% and the hardness of the corrosion preventive coating formed was Hv 175. A salt water spray test was carried out in the same way as in Comparative Example 1, but no rust occurrence was observed 2880 hours after the test. Natural potential measurement was made in the same way as in Comparative Example 1. The measurements indicated −691 mV in relation to the service water and −857 mV in relation to 3% common salt water. Therefore, the natural potential of the coating was found lower than the natural potential of the ductile cast iron of Comparative Example 1, and was verified as having a corrosion preventive effect as a sacrifice anode. Measurement results with respect to these characteristics are shown in Table 1.

Example 2

A quenched aluminum alloy powder comprised of 80 wt % Al and 20 wt % Mn was produced, and this alloy powder was sprayed over the surface of a cast iron pipe in the same way as already mentioned, whereby a corrosion preventive coating was formed. As Table 1 indicates, the coating had hardness and corrosion preventive characteristics of same level as or higher than the coating of Example 1.

Examples 3–5

A quenched aluminum alloy powder including Si in addition to Al and Mn, with such a composition as shown in Table 1, was produced, and this alloy powder was sprayed over the surface of a cast iron pipe in the same way as already mentioned, whereby a corrosion preventive coating was formed. The addition of the Si resulted in an increase in hardness over the coatings of Examples 1 and 2 and, on the basis of this fact, it was found that further improvement in corrosion preventive performance could be expected.

Examples 6 and 7

A quenched aluminum alloy powder including Mg in addition to Al and Mn, with such a composition as shown in

TABLE 1

| | Powder | Power composition (wt %) | | | | Spray yield | Coating hardness | Salt water spray test | Natural potential(mV) | |
|---|---|---|---|---|---|---|---|---|---|---|
| | components | Al | Mn | Si | Mg | (%) | (Hv) | (hrs.)* | Service water | 3% common salt water |
| Example 1 | Al—Mn | 90 | 10 | — | — | 45 | 175 | over 2880 | −691 | −857 |
| Example 2 | Al—Mn | 80 | 20 | — | — | 43 | 203 | over 2880 | −689 | −880 |
| Example 3 | Al—Mn—Si | 82.5 | 7.5 | 10 | — | 36 | 239 | over 2880 | −575 | −741 |
| Example 4 | Al—Mn—Si | 86 | 10 | 4 | — | 40 | 222 | over 2880 | −650 | −819 |
| Example 5 | Al—Mn—Si | 77 | 15 | 8 | — | 37 | 237 | over 2880 | −622 | −777 |
| Examp1e 6 | Al—Mn—Mg | 85 | 7.5 | — | 7.5 | 38 | 216 | over 2880 | −728 | −862 |
| Example 7 | Al—Mn—Mg | 70 | 15 | — | 15 | 36 | 253 | over 2880 | −737 | −872 |
| Example 8 | Al—Mn—Si—Mg | 83 | 10 | 4 | 3 | 35 | 245 | over 2880 | −681 | −856 |
| Example 9 | Al—Mn—Si—Mg | 65 | 20 | 10 | 5 | 35 | 251 | over 2880 | −669 | −815 |
| Comp. Ex. 1 | Ductile cast iron pipe | — | — | — | — | — | 200~220 | 24 | −673 | −666 |
| Comp. Ex. 2 | Zn | — | — | — | — | 53 | 58 | 336 | −898 | −1015 |
| Comp. Ex. 3 | Al | 100 | — | — | — | 83 | 43 | 216 | −697 | −1012 |
| Comp. Ex. 4 | Al—Mn | 97.5 | 2.5 | — | — | 59 | 103 | 240 | −695 | −933 |
| Comp. Ex. 5 | Al—Mn | 70 | 30 | — | — | 41 | 210 | 2400 | −683 | −828 |
| Comp. Ex. 6 | Al—Mn—Si | 65 | 10 | 25 | — | 27 | 357 | 960 | −560 | −725 |
| Comp. Ex. 7 | Al—Mn—Si | 50 | 30 | 20 | — | 22 | 326 | 1200 | −549 | −701 |
| Comp. Ex. 8 | Al—Mn—Mg | 60 | 20 | — | 20 | 28 | 288 | 2160 | −803 | −844 |

*Hours spent before rusting starts to occur.

Table 1, was produced, and this alloy powder was sprayed over the surface of a cast iron pipe in the same way as already mentioned, whereby a corrosion preventive coating was formed. The addition of the Mg resulted in some lowering in natural potential from the level of natural potential in Examples 1–5 and, on the basis of this fact, it was found that further improvement in corrosion preventive performance could be expected.

Examples 8 and 9

A quenched aluminum alloy powder including Si and Mg in addition to Al and Mn, with such a composition as shown in Table 1, was produced, and this alloy powder was sprayed over the surface of a cast iron pipe in the same way as already mentioned, whereby a corrosion preventive coating was formed. In this case, an increase in coating hardness due to addition of Si and some lowering in natural potential due to addition of Mg were ascertained and, on the basis of this fact, it was found that further improvement in corrosion preventive performance could be expected.

Comparative Example 2

A spray material comprised of Zn only was sprayed over the surface of a cast iron pipe, whereby a corrosion preventive coating was formed. In this case, natural potential could be substantially lowered as shown in Table 1, but the hardness of the coating was extremely low. A salt water spray test witnessed that rusting occurred 336 hours after the test. Thus, any satisfactory corrosion preventive effect could not be obtained.

Comparative Example 3

A spray material comprised of Al only was sprayed over the surface of a cast iron pipe, whereby a corrosion preventive coating was formed. In this case, natural potential could be substantially lowered, but the hardness of the coating was extremely low. A salt water spray test witnessed that rusting occurred 216 hours after the test. Thus, any satisfactory corrosion preventive effect could not be obtained.

Comparative Example 4

A quenched aluminum alloy powder comprised of 97.5 wt % Al and 2.5 wt % Mn was produced, and this alloy powder was sprayed over the surface of a cast iron pipe in the same way as already described, whereby a corrosion preventive coating was formed. In this case, the Mn content was less than the defined range of the invention and, therefore, the hardness of the coating was low. A salt water spray test witnessed that rusting occurred 240 hours after the test. Thus, any satisfactory corrosion preventive effect could not be obtained.

Comparative Example 5

A quenched aluminum alloy powder comprised of 70 wt % Al and 30 wt % Mn was produced, and this alloy powder was sprayed over the surface of a cast iron pipe in the same way as already described, whereby a corrosion preventive coating was formed. In this case, the Mn content was more than the defined range of the invention, so that the corrosion preventive coating became brittle only to cause the corrosion preventive characteristic of the coating to lower. A salt water spray test witnessed that rusting occurred 2400 hours after the test.

Comparative Example 6

A quenched aluminum alloy powder comprised of 65 wt % Al, 10 wt % Mn, and 25 wt % Si was produced, and this alloy powder was sprayed over the surface of a cast iron pipe in the same way as already described, whereby a corrosion preventive coating was formed. In this case, the Si content was more than the defined range of the invention, so that the corrosion preventive coating became brittle only to cause the corrosion resistance of the coating to lower. A salt water spray test witnessed that rusting occurred 960 hours after the test. The spray yield was lowered to 27%.

Comparative Example 7

A quenched aluminum alloy powder comprised of 50 wt % Al, 30 wt % Mn, and 20 wt % Si was produced, and this alloy powder was sprayed over the surface of a cast iron pipe in the same way as already described, whereby a corrosion preventive coating was formed. In this case, the Mn and Si contents were more than the defined ranges of the invention, so that the corrosion preventive coating became brittle as in Comparative Examples 5 and 6, only to cause the corrosion resistance of the coating to lower. A salt water spray test witnessed that rusting occurred 1200 hours after the test. The spray yield was lowered to 22%.

Comparative Example 8

A quenched aluminum alloy powder comprised of 60 wt % Al, 20 wt % Mn, and 20 wt % Mg was produced, and this alloy powder was sprayed over the surface of a cast iron pipe in the same way as already described, whereby a corrosion preventive coating was formed. In this case, the Mg content was more than the defined range of the invention, so that the corrosion preventive coating became brittle only to cause the corrosion resistance of the coating to lower. A salt water spray test witnessed that rusting occurred 2160 hours after the test. The spray yield was lowered to 28%.

What is claimed is:

1. A cast iron pipe surface-modified for preventing corrosion, in which a corrosion preventive coating is formed on the surface of iron material thereof, characterized in that, the corrosion preventive coating is comprised of an aluminum alloy containing not less than 5 wt % but not more than 25 wt % of Mn, the remainder being Al, said aluminum alloy being quench-solidified so that the manganese is present as a supersaturated solid solution in an aluminum phase and that intermetallic compounds comprised of manganese and aluminum are dispersed in an aluminum base.

2. A cast iron pipe as defined in claim 1, wherein the corrosion prevention coating is comprised of an aluminum alloy containing, in addition to Mn, more than 0 wt % but not more than 15 wt % of Si or Mg or both combined together, the remainder be Al, said aluminum alloy being quench-solidified so that the manganese and the silicon and/or magnesium are present as a supersaturated solid solution in an aluminum phase and that intermetallic compounds comprised of manganese and aluminum, intermetallic compounds comprised of silicon and aluminum and/or intermetallic compounds comprised of magnesium and aluminum are dispersed in an aluminum base.

3. A method of modifying the surface of a cast iron pipe for preventing corrosion, in which the pipe has a corrosion preventive coating formed on the surface of its iron material, characterized in that, the method comprises thermal spraying of a quenched aluminum alloy onto the surface of the iron material of the pipe, the quenched aluminum alloy containing not less than 5 wt % but not more than 25 wt % of Mn, the remainder being Al, the quenched aluminum alloy being such that the manganese is present as a supersaturated solid solution in an aluminum phase and that intermetallic compounds comprised of manganese and aluminum are dispersed in an aluminum base, the thermal spraying being flame spraying so that the aluminum alloy is kept in a semi-molten state during spraying in which only the surface of the alloy is melted.

4. A method as defined in claim 3, wherein the quenched aluminum alloy contains, in addition to Mn, more than 0 wt % but not more than 15 wt % of Si or Mg or both combined together, the remainder being Al, the aluminum alloy being such that the manganese and the silicon and/or magnesium are present as a supersaturated solid solution in the aluminum phase and that intermetallic compounds comprised of manganese and aluminum, intermetallic compounds comprised of silicon and aluminum and/or intermetallic compounds comprised of magnesium and aluminum are dispersed in an aluminum base.

5. A method as defined in claim 4, wherein the quenched aluminum alloy is flame-sprayed or plasma-sprayed onto the surface of the iron material of the pipe.

* * * * *